US009399342B2

(12) United States Patent
Marchant

(10) Patent No.: US 9,399,342 B2
(45) Date of Patent: Jul. 26, 2016

(54) SETTING START VOLTAGE FOR DRIVING ACTUATING ELEMENTS

(71) Applicant: Xaar Technology Limited, Cambridge (GB)

(72) Inventor: James Edward David Marchant, Buckingham (GB)

(73) Assignee: Xaar Technology Limited, Cambridge (GB)

( * ) Notice: Subject to any disclaimer, the term of this patent is extended or adjusted under 35 U.S.C. 154(b) by 0 days.

(21) Appl. No.: 14/850,303

(22) Filed: Sep. 10, 2015

(65) Prior Publication Data

US 2016/0067961 A1 Mar. 10, 2016

(30) Foreign Application Priority Data

Sep. 10, 2014 (GB) ..... 1415987.5

(51) Int. Cl.
*B41J 29/38* (2006.01)
*B41J 2/045* (2006.01)

(52) U.S. Cl.
CPC ..... *B41J 2/04541* (2013.01); *B41J 2/0455* (2013.01); *B41J 2/0459* (2013.01); *B41J 2/04548* (2013.01); *B41J 2/04581* (2013.01); *B41J 2/04598* (2013.01)

(58) Field of Classification Search
CPC .. B41J 2/04541; B41J 2/04548; B41J 2/0455; B41J 2/0457; B41J 2/04581; B41J 2/0459; B41J 2/04598
See application file for complete search history.

(56) References Cited

U.S. PATENT DOCUMENTS 5,453,767 A 9/1995 Chang et al.
6,276,772 B1 * 8/2001 Sakata ..... B41J 2/04506 310/316.03
2003/0234826 A1 12/2003 Hosono et al.
2010/0171778 A1 7/2010 Ozawa

OTHER PUBLICATIONS

Search Report dated Mar. 9, 2015 for GB Application No. 1415987.5, 5 pages.

* cited by examiner

*Primary Examiner* — Julian Huffman
(74) *Attorney, Agent, or Firm* — Patterson Thuente Pedersen, P.A.

(57) ABSTRACT

A printhead provides actuation pulses for driving actuating elements from a common drive waveform via respective switching circuits, the waveform having a pre-charge ramp followed by a steeper slope. A start voltage of a leading edge of the actuation pulse is set by opening the switching circuit to decouple the common drive waveform from its actuating element part way along the pre-charge ramp. After the pre-charge ramp the actuating element is coupled again to the common drive waveform, so that the voltage across the actuating element follows the steeper slope to form the leading edge. Adjusting the timing of the decoupling adjusts the start voltage, enables trimming relative to other actuating elements. The gentle slope of the pre-charge ramp enables the precision of timing of switching to be more relaxed, so that trigger circuitry for controlling the switching circuit can be simpler, smaller, cheaper and thermally more efficient.

17 Claims, 7 Drawing Sheets

SETTING START VOLTAGE FOR DRIVING ACTUATING ELEMENTS

RELATED APPLICATION

The present application claims priority to GB Application No. 1415987.5 filed Sep. 10, 2014, which is hereby incorporated herein in its entirety by reference.

TECHNICAL FIELD

The present invention relates to methods of operating a printhead, and to apparatus for providing actuation pulses for driving a plurality of actuating elements, which apparatus can be in the form of circuitry, circuitry on an integrated circuit, or a printhead having such circuitry.

BACKGROUND

It is known to provide printheads having driver circuits for driving actuating elements to eject fluid from an actuating chamber in inkjet printers. Existing piezoelectric ('piezo') cold switch driver ASICs have the limitation of the cost and power dissipation of the high voltage pass gates and associated level shifter used to gate a cold switch power waveform on to each individual actuating element. One problem is how to provide electrical drive for a piezo actuating element at the lowest cost and with the lowest power dissipation while still meeting minimum drive requirements.

The inkjet industry has been working intensively on how to drive piezoelectric actuating elements for more than twenty years. Multiple drive methods have been produced and there are multiple different types in use today. Some are briefly discussed now.

Hot Switch: This is the class of driving methods that keep the demux function and the power dissipation (CV^2) in the same driver IC (Integrated Circuit). This was the original drive method, before cold switch became popular.

Rectangular Hot Switch: This describes hot switch systems that have no flexible control over rise and fall time and only two voltages (0V and 30V for example). In some cases waveform delivery is uniform to all the actuating elements. The waveform has some level of programmability.

DAC Hot Switch describes a class of drive options that has a logic driving an arbitrary digital value stream to a DAC (Digital Analog Converter) per actuating element, and outputs a high voltage drive power waveform scaled from this digital stream. In terms of driving flexibility, this option has the most capability. It is limited only by the number of digital gates and the complexity that that system designers can use and/or tolerate.

Cold Switch Demux: This describes an arrangement in which all actuating elements are fed the same drive signal through a pass gate type demultiplexer. The drive signal is gated at sub-pixel speeds.

It is also known to provide some factory calibration of differences between individual actuating elements and to provide compensation by trimming the drive signal applied to the different actuating elements. Patent application US20130321507 shows compensating for actuating element variations by altering rise times of drive pulses for individual actuating elements and thus alters the properties of an ejected droplet. The ejection rate is altered by changing an amount of series resistance or an internal resistance of a drive circuit.

It is known from US20120262512A1 to provide a cold switched arrangement using a common drive waveform switched to provide a drive signal for each actuating element.

The highest voltage and the lowest voltage of the drive signal or the basic shape of the waveform of the drive signal can be changed by changing the timing of switching. This can be used to correct for variations between the actuating elements.

SUMMARY

Embodiments of the invention can provide improved apparatus or methods or computer programs. According to a first aspect of the invention, there is provided a method of operating a printhead to provide actuation pulses for driving actuating elements for ejecting droplets from an actuator and having steps of: providing a common drive waveform for coupling to the actuating elements via respective switching circuits, the common drive waveform having a pre-charge ramp followed by a steeper slope, and setting a start voltage of a leading edge of an actuation pulse according to a trim input by opening a first of the switching circuits to decouple the common drive waveform from a first of the actuating elements at least part way along the pre-charge ramp, in order to maintain the start voltage across the actuating element. There is also a step of coupling the first of the actuating elements to the common drive waveform after the pre-charge ramp, in order to enable the voltage across the first actuating element to follow the steeper slope of the common drive waveform to form the leading edge. Providing a pre-charge ramp in the common drive waveform can enable adjustment of the start voltage of the leading edge to enable trimming relative to other actuating elements. As the ramp can be a gentle slope, the precision of timing for a given precision of trimming can be more relaxed than other techniques relying on switching during the steeper slope. Thus trigger circuitry for controlling switches can be simpler, smaller, cheaper and thermally more efficient. This is particularly valuable where there are hundreds or thousands of such actuating elements in a printer. The ramp allows a wide range of adjustment, and is compatible to enable combination with other trim techniques such as adjusting the peak of the actuation pulse, or biasing the return path. These benefits can apply whether the slope of the pre-charge ramp has a positive sign or a negative sign, and whether the steeper slope has the same sign or the opposite sign to the pre-charge ramp.

Any additional features can be added to any of the aspects, or can be disclaimed, and some such additional features are described and some set out in dependent claims. One such additional feature is the common drive waveform having the steeper slope directly after the pre-charge ramp. This can enable simpler switching as the common drive waveform has a relatively simple shape, thus the circuitry can have lesser requirements for space, cooling and cost and so on.

Another such additional feature is the first switching circuit comprising a first switch and the step of coupling after the pre-charge ramp comprising closing the first switch. This again can help enable the circuitry to have lesser requirements for space, cooling and cost and so on.

Another such additional feature is a slope of the pre-charge ramp having the same sign as a sign of the steeper slope. This can help to enable the switching to be carried out at lower voltages and keep the circuitry simple, though it is also possible to provide a pre-charge ramp with a slope of opposite sign.

Another such additional feature is the common drive waveform having a return portion between the pre-charge ramp and the steeper slope such that a voltage range of the pre-charge ramp overlaps a voltage range of the steeper slope. This dual step waveform can enable the steeper slope to have a greater height, and can reduce any voltage difference between the start voltage and a start of the steeper slope, to reduce any thermal dissipation caused by such voltage difference when coupling the actuating element to the common drive waveform after the pre-charge ramp.

Another such additional feature is the first switching circuit comprising a first switch, and a diode coupled in parallel with the first switch, and the step of coupling the respective actuating element after the pre-charge ramp comprising using the diode to conduct when the common drive waveform, during the steeper slope, exceeds the start voltage by a threshold. This can help reduce or avoid the need for precise timing of switching to achieve the step of coupling. This in turn can help enable the circuitry to have lesser requirements for space, cooling and cost and so on.

Another such additional feature is the step of decoupling comprising opening a second switch coupled in series with the diode to isolate the actuating element for the rest of the pre-charge ramp. This is one efficient way of maintaining the start voltage across the actuating element Another such additional feature is a step of closing the first switch after the diode has started conducting. This can help enable dissipation by the diode to be reduced, and enable conduction to form the trailing edge of the actuation pulse.

Another aspect of the invention provides apparatus for providing actuation pulses for driving a plurality of actuating elements of a printhead from a common drive waveform, the common drive waveform having a pre-charge ramp followed by a steeper slope, and the apparatus having a first switching circuit for coupling a respective one of the actuating elements to the common drive waveform, and a trigger circuit coupled to receive a trim input and a synchronisation signal for synchronisation with the common drive waveform and coupled to the first switching circuit to control the first switching circuit to set a start voltage of a leading edge of an actuation pulse according to the trim input. This trigger circuit is configured to open the first switching circuit to decouple the common drive waveform from the respective actuating element at least part way along the pre-charge ramp, in order to maintain the start voltage across the actuating element, and also configured to control the first switching circuit to couple the actuating element to the common drive waveform after the pre-charge ramp, in order to enable the voltage across the actuating element to follow the steeper slope of the common drive waveform to form the leading edge.

Another such additional feature is the first switching circuit comprising a first switch, and the trigger circuit being configured to close the first switch to couple the actuating element to the common drive waveform after the pre-charge ramp, to enable the voltage across the actuating element to follow the steeper slope of the common drive waveform to form the leading edge.

Another such additional feature is the trigger circuit being configured to close the first switch when the common drive waveform, during the steeper slope, reaches the start voltage, for the case that the pre-charge ramp has a slope of the same sign as that of the steeper slope, and the common drive waveform has a return portion between the pre-charge ramp and the steeper slope such that a start of the steeper slope is in a voltage range of the pre-charge ramp.

Another such additional feature is the first switching circuit comprising a first switch, a diode coupled in parallel with the first switch, and a second switch coupled in series with the diode, and the trigger circuit being configured to carry out the decoupling by opening the first and second switches, and being configured to carry out the coupling, for the case that the pre-charge ramp has a slope of the same sign as that of the steeper slope, and the common drive waveform has a return portion between the pre-charge ramp and the steeper slope such that a start of the steeper slope is within a voltage range of the pre-charge ramp, by closing the second switch before the start of the steeper slope, in order to enable the diode to conduct when the common drive waveform during the steeper slope exceeds the start voltage by a threshold.

Another such additional feature is the apparatus being in the form of an integrated circuit. Another such additional feature is the apparatus having a printhead having a common drive waveform circuit for generating the common drive waveform, and a plurality of the actuating elements coupled to the first switching circuit.

Another such additional feature is the apparatus being configured such that the first actuating element is coupled between the first switching circuit and the common drive waveform circuit. This can help enable use of lower voltages for controlling the switching circuit, and thus enable less thermal dissipation, for example in any level shift type circuit.

Numerous other variations and modifications can be made without departing from the claims of the present invention. Therefore, it should be clearly understood that the form of the present invention is illustrative only and is not intended to limit the scope of the present invention.

BRIEF DESCRIPTION OF THE DRAWINGS

How the present invention may be put into effect will now be described by way of example with reference to the appended drawings, in which.

DETAILED DESCRIPTION

Figure 1:
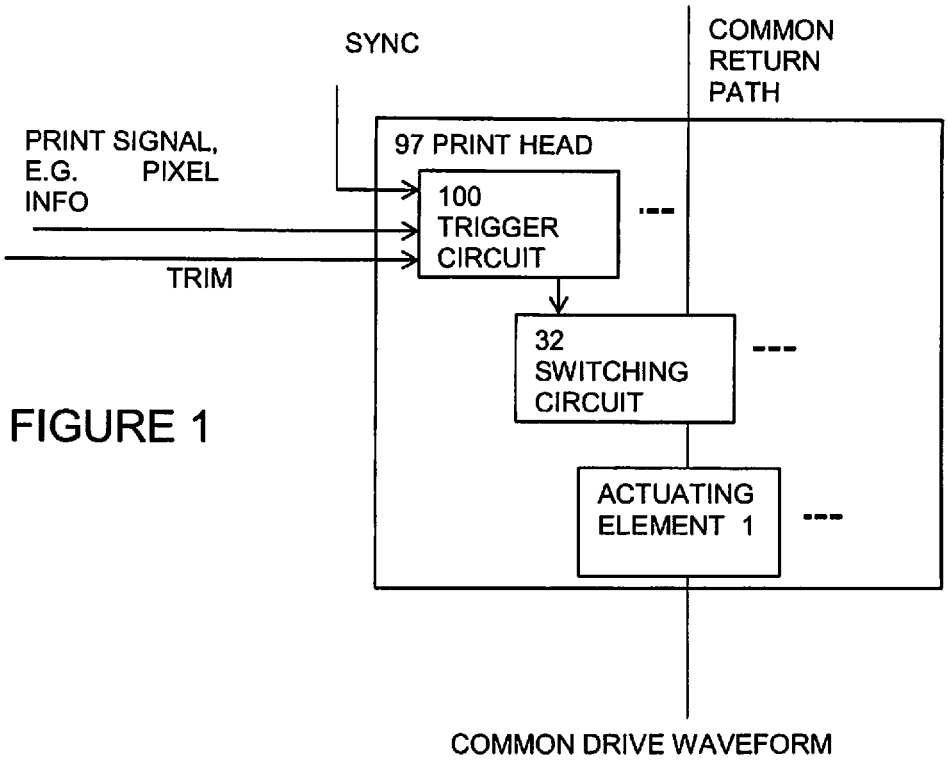
FIG. 1 shows a schematic view of apparatus according to an embodiment having a switching circuit and a trigger circuit.

The present invention will be described with respect to particular embodiments and with reference to drawings but note that the invention is not limited to features described, but only by the claims. The drawings described are only schematic and are non-limiting. In the drawings, the size of some of the elements may be exaggerated and not drawn to scale for illustrative purposes.

Definitions

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

References to programs or software can encompass any type of programs in any language executable directly or indirectly on any computer.

References to processor or computer are intended to encompass any kind of processing hardware which can be implemented in any kind of logic or analog circuitry, integrated to any degree, and not limited to general purpose processors, digital signal processors, ASICs, FPGAs, discrete components or logic and so on, and are intended to encompass implementations using multiple processors which may be integrated together, or co-located or distributed at different locations for example.

References to actuating chambers are intended to encompass any kind of actuating chamber comprising one or more actuating elements for effecting the ejection of droplets from at least one actuating element that is associated with the actuating chamber. The actuating chamber may eject any kind of fluid from at least one fluid reservoir for printing images or 3D objects, for example, onto any kind of media, the actuating chambers having actuating elements for causing droplet ejection in response to an applied electrical voltage or current, and the actuating chambers representing any type of suitable configuration of the geometry between its actuating element(s) to eject droplets, such as for example but not limited to roof mode or shared wall geometry.

References to actuating elements are intended to encompass any kind of actuating element to cause the ejection of droplets from the actuating chamber, including but not limited to piezoelectric actuating elements typically having a predominantly capacitive circuit characteristic. Furthermore, the arrangement and/or dimensions of the actuating element are not limited to any particular geometry or design, and in the case of a piezoelectric element may take the form of, for example, thin film, thick film, shared wall, or the like.

References to groups or sets of the actuating elements are intended to encompass linear arrays of neighbouring actuating elements, or 2-dimensional rectangles or other patterns of neighbouring actuating elements, or any pattern or arrangement, regular or irregular or random, of neighbouring or non-neighbouring actuating elements.

References to differences between actuating elements is intended to encompass anything that can affect a uniformity of print output, for example static manufacturing differences or dynamic differences such as temperature-dependent effects which may differ with both temperature and location, and cross talk effects where a print output is affected by whether adjacent actuating elements are fired simultaneously, which is therefore image dependent. Such cross talk can include temporal cross talk from previous firing of the same actuating element.

Reference to a sign of a slope is intended to encompass any indication of whether the rate of change is positive or negative, regardless of whether the voltage is positive or negative, so a change from −3 v to −2 v over time t would be a slope having a positive sign.

Introduction to Embodiments

By way of introduction to features of embodiments, some issues with current systems will be discussed. The properties of inkjet droplets need to be adjusted, per droplet, to obtain optimum uniform print quality. These properties may include droplet velocity, volume, droplet formation from sub-drops, tail break-off and so on. In a cold switch system where the same waveform is presented to multiple actuating elements simultaneously, a method is needed to modify these properties on each of the actuating elements independently. Each printhead will exhibit a capacitance. The velocity of the droplet produced by the changing voltage of an actuation pulse can be controlled by varying the height of the voltage of that pulse (ΔV). A fast rise time is also required to produce a droplet. There is a limit for both of these parameters below which a voltage pulse will not produce a droplet. Since it is ΔV that is important, not the absolute value of voltage, a signal that changes from 0 to 30 volts for example can have the same effect as a signal from 10 to 40 volts. Therefore if an amount of droplet volume/velocity trimming is required that can be obtained from a 10V ΔV from a wave form of 40V amplitude, then either the beginning or end point can be adjusted.

Adjusting the amplitude of a 40V waveform down to 30V for example, by adjusting the maximum excursion, can be achieved, but at the expense of power dissipated in modifying the signal. The new approach here is to apply a charge to the actuating element capacitance in such a way as to change the starting voltage of the actuation pulse. If the waveform that applies this charge is correctly formed as a pre-charge ramp, then it will not itself produce a droplet, but can be used to store a charge on the actuating element. If a low level 'non-droplet' pulse is applied to the actuating element, the capacitance of the actuating element will store that charge unless a discharge path is provided. Thus far, the common drive waveform amplifier has been considered to charge the actuating element on the leading edge of the waveform pulse, hold charge for the pulse duration and discharge on the trailing edge of the waveform.

In the new trimming according to embodiments, the droplet pulse, typically a trapezoidal shaped signal with high slew rate of at least the leading edge, is modified with the addition of a slow slew rate pre-charge ramp with a maximum voltage equal to or slightly exceeding the maximum desired level of adjustment. By operating the switching circuit so that the actuating element is exposed to this voltage ramp and by selecting the correct point in time where the switching circuit is opened, a charge may be stored on the actuating element, changing the ΔV.

The switching circuit can be implemented in various ways, and in many cases can be operated mostly at or near a zero crossing point where there is little or no voltage across the switching circuit, and so it does not dissipate power. In some embodiment there is one time when the switching circuit is operated with a voltage present across, as described below with reference to FIG. 2. In this case the common drive waveform is changing slowly with respect to the actuating element voltage and so only a small amount of heat is generated—low enough to be still considered a cold switching solution.

FIG. 1, Printhead According to an Embodiment.

Figure 2:
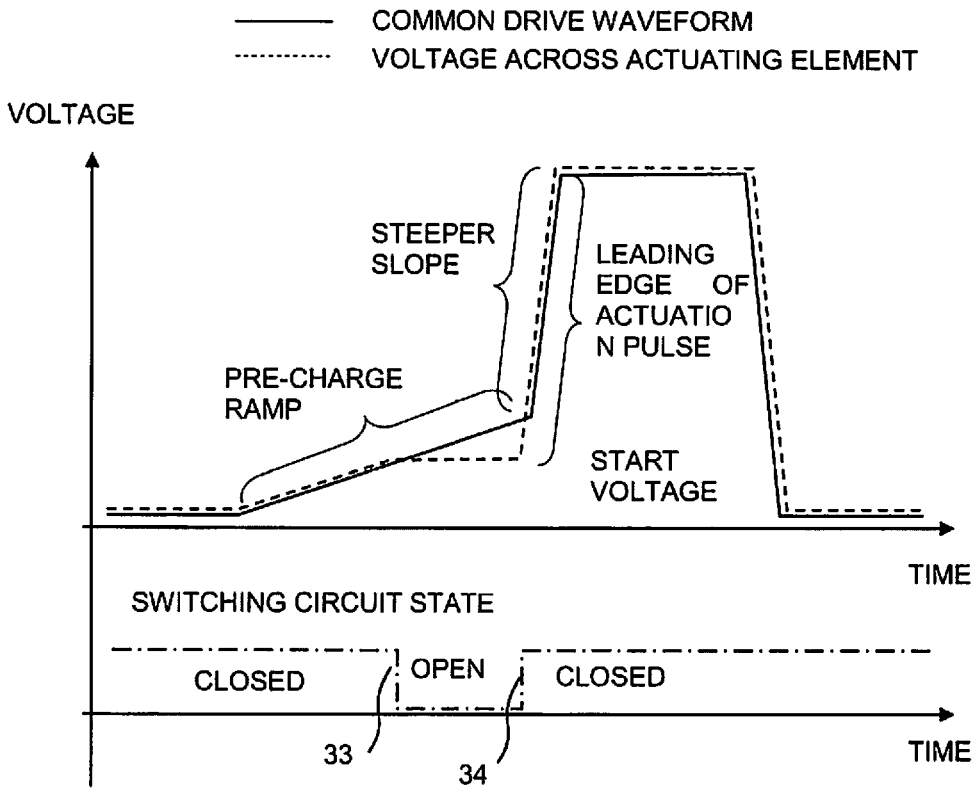
FIG. 2 shows a time chart showing operation according to an embodiment having a common drive waveform having a pre-charge ramp and a steeper slope.

FIG. 1 shows a schematic view of apparatus according to an embodiment, in the form of circuitry for use on a printhead 97 for providing actuation pulses for driving a plurality of actuating elements 1 from a common drive waveform. The dashed lines on the right of the figure indicate the possibility of repeating a trigger circuit, a switching circuit and/or an actuation element component multiple times. An example of the common drive waveform is shown in FIG. 2, which shows notably a pre-charge ramp followed by a steeper slope. The circuit has a first switching circuit 32 for coupling a respective one of the actuating elements to the common drive waveform, and a trigger circuit 100 for controlling the switching circuit. The trigger circuit is coupled to receive a trim signal and a synchronisation signal (sync) for synchronisation with the common drive waveform and coupled to the first switching circuit to control the first switching circuit to set a start voltage of a leading edge of an actuation pulse according to the trim signal. The synchronisation signal can be a copy of the common drive waveform or any clock or timing signal representing a timing of the start of a cycle of the waveform in any way. The trigger circuit is configured to open the first switching circuit to decouple the common drive waveform from the respective actuating element at least part way along the pre-charge ramp according to the trim signal, in order to maintain the start voltage across the actuating element, and also configured to control the first switching circuit to couple the actuating element to the common drive waveform after the pre-charge ramp. This can enable the voltage across the actuating element to follow the steeper slope of the common drive waveform to form the leading edge with the start voltage adjusted according to the trim signal.

Also shown is a print signal input to the trigger circuit so that the switching circuit can be left open for the duration of the cycle of the waveform for a given pixel if the print signal indicates that there is no dot to be printed for that pixel of an image. In principle the decoupling can be timed for example by determining the time when the pre-charged ramp has reached a desired proportion of the entire ramp, or a proportion of the duration of the ramp, or a desired level, according to the trim signal. The trim signal can be generated in various ways, to indicate differences between actuating elements, for example from a look-up table, or by a processor based on measurements of output or temperature for example, or from information such as manufacturing calibration results, or print image information for example.

FIG. 2, Waveforms for Single Step Example

FIG. 2 shows a time chart showing voltage over time for a single pixel cycle for the operation of the embodiment of FIG. 1 or other embodiments. A solid line shows an example of a common drive waveform, and a dotted line shows a resulting actuation pulse trimmed by adjusting the starting voltage. Below these waveforms is a dot-dash line showing a switching state, open or closed, of the switching circuit shown along the same time axis at the same scale. The common drive waveform has a pre charge ramp which has a single step shape in the sense that the steeper slope follows directly from the pre-charge ramp without any return portion in between (in contrast to FIG. 3 described below). As can be seen, at the outset of the cycle the switching circuit closes while the common drive waveform is near zero, a common drive waveform amplifier circuit being in the resting state; allowing the voltage across the actuating element to start to track the common drive waveform. The actuating element firing cycle has two stages as follows.

Stage 1: Pre-charge Ramp

The switching circuit is in a closed state before the waveform cycle begins. The slow rise of the pre-charge ramp part of the waveform charges up the capacitance of the piezo actuating element. The slope of this ramp should be gentle enough to avoid triggering a droplet. At a point in time 33, where the voltage on the actuating element is at the correct level to achieve the desired level of droplet velocity/volume trimming, the switching circuit is opened. The electrode of the actuating element coupled by the switching circuit becomes floating. Thus the capacitance of the actuating element causes that electrode to follow the electrode coupled to the common drive waveform. This means the voltage across the actuating element is held at a constant voltage while the waveform rises to its maximum pre-charge ramp level.

Stage 2: Droplet Pulse

At the start of the steeper slope of the common drive waveform, at time point 34, the switch is closed, allowing the actuating element to track the common drive waveform through the droplet pulse. The amount of the rise in voltage along the steeper slope, the $\Delta V$, is the difference between the start voltage, and the maximum voltage level of the pulse. For no trimming, stage 1 is omitted and the start voltage of the steeper slope would be close to zero in this case. There is some power dissipation when the switching circuit closes if there is a voltage difference across the switching circuit at the point of closing. This power dissipation would be at a minimum if the switch is operated in stage 2 when the voltage of the waveform is the same as the voltage stored on the actuating element capacitance. One way of reducing or avoiding this dissipation issue will be described with reference to FIGS. 3 and 8.

In FIG. 2 both the pre-charge ramp and the steeper slope are shown with a slope having a positive sign. Both slopes could be arranged with slopes of negative sign, or the pre-charge ramp could have a positive sign and the steeper slope have a negative sign, or the pre-charge ramp could have a negative sign and the steeper slope have a positive sign.

Figure 3:
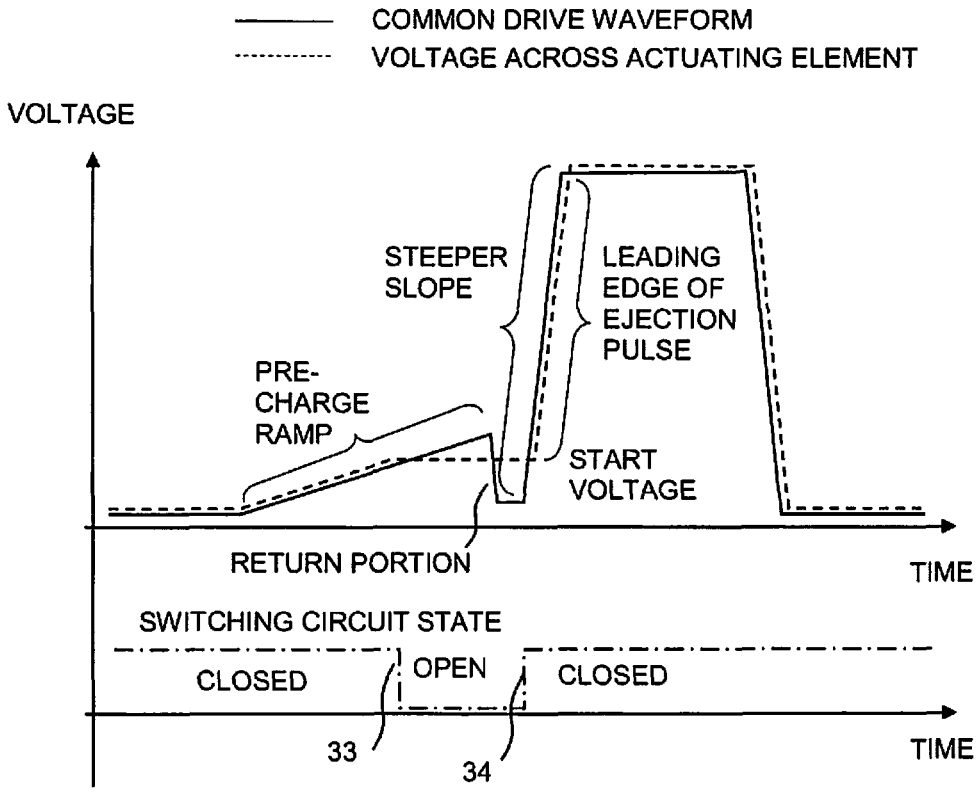
FIG. 3 shows a time chart showing operation according to an embodiment having a common drive waveform having a pre-charge ramp, a return portion and a steeper slope.

FIG. 3, Waveforms for Dual Step Example

FIG. 3 shows a time chart similar to that of FIG. 2, except for the addition of a return portion. The significance of this will be explained below. FIG. 3 shows voltage over time for a single pixel cycle for the operation of the embodiment of FIG. 1 or other embodiments. As in FIG. 2 a solid line shows an example of a common drive waveform, and a dotted line shows a resulting actuation pulse trimmed by adjusting the starting voltage. Below these waveforms is a dot-dash line showing a switching state, open or closed, of the switching circuit shown along the same time axis at the same scale. The common drive waveform has a pre-charge ramp which has a dual step shape (in contrast to FIG. 2 described above) in the sense that before the steeper slope there is a return portion in which the voltage drops or dips below the level of the end of the pre-charge ramp. As shown it returns to a level of the start of the pre-charge ramp, so that the start voltage of the steeper slope is nearly the same as the start of the pre-charge ramp. Optionally the return portion can return to the voltage of any point of the pre-charge ramp, or to a voltage lower than the start of the pre-charge ramp. As in FIG. 2, at the outset of the cycle the switching circuit closes while the common drive waveform is near zero, a common drive waveform amplifier circuit being in the resting state; allowing the voltage across the actuating element to start to track the common drive waveform. The actuating element firing cycle is similar to that described for FIG. 2, as follows.

Figure 8:
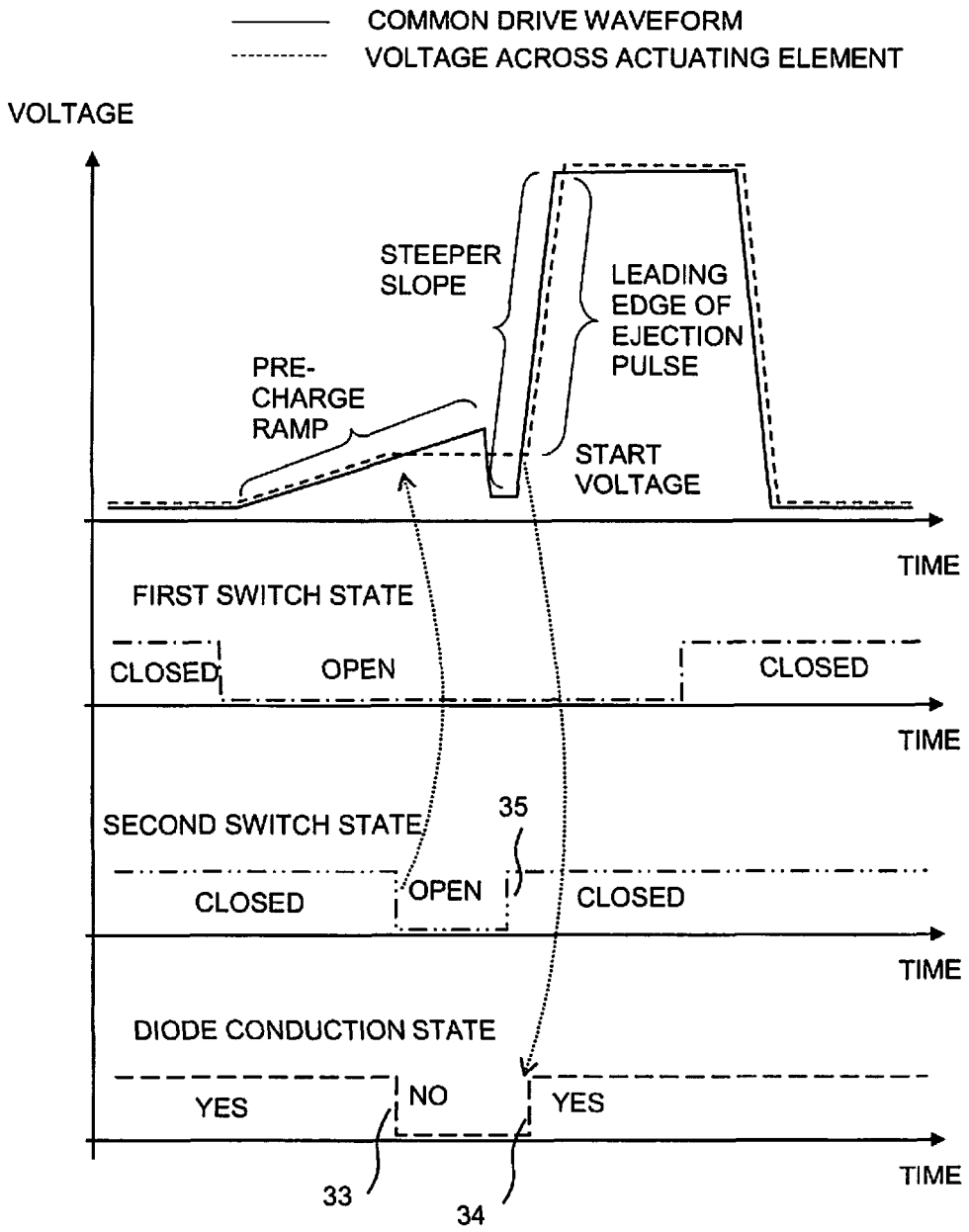
FIG. 8 shows a time chart showing operation according to an embodiment having a common drive waveform having a pre-charge ramp, a return portion and a steeper slope, and showing a conduction state of a diode.

The switching circuit is in a closed state before the waveform cycle begins. The slow rise of the pre-charge ramp part of the waveform charges up the capacitance of the piezo actuating element. At a point in time 33, where the voltage on the actuating element is at the correct level to achieve the desired level of droplet velocity/volume trimming, indicated by the trim signal, the switching circuit is opened. A dotted line arrow in FIG. 8 shows that the opening of the second switch causes the waveform of the voltage across the actuating element to depart from the common drive waveform part way along the pre-charge ramp. The electrode of the actuating element coupled by the switching circuit becomes floating. Thus the capacitance of the actuating element causes that electrode to follow the electrode coupled to the common drive waveform. This means the voltage across the actuating element is held at a constant voltage while the waveform rises to its maximum pre-charge ramp level.

At time point 34, the switch is closed, allowing the actuating element to track the common drive waveform through the droplet pulse. In contrast to FIG. 2, if the time of closing the switching circuit is timed to occur at the time when the steeper slope meets the start voltage, then there is little or no voltage difference across the switching circuit at the point of closing. This is possible because of the return portion in the common drive waveform, which can lower the voltage of the start of the steeper slope, to be lower than some or all of the possible range of the start voltages. However, the steeper slope typically has a high slew rate, depending on the characteristics of the actuating element and actuating chamber to achieve a desired droplet velocity and droplet weight. This high slew rate means a timing of the closing needs to be very precise to maintain a low dissipation during the closing of the switching circuit. In contrast, the timing of the opening of the switching circuit, which affects the precision of the trimming, is easier to achieve as the slope of the pre-charge ramp can be gentler. There are various ways of achieving such timing with precise trigger circuitry, and one way of doing so without needing such precise trigger circuitry will be described with reference to FIGS. 6, 7 and 8.

FIGS. 4-7, Switching Circuit Implementations

Figure 4:
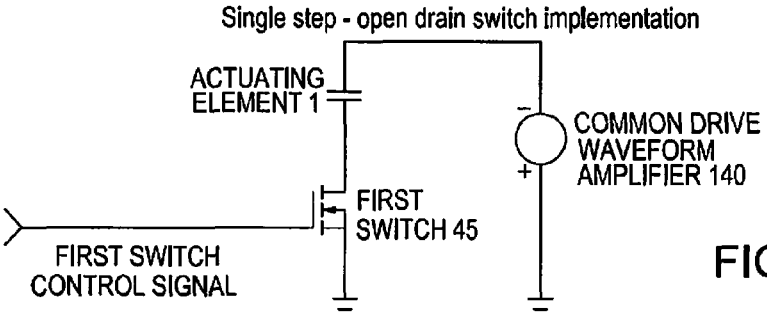
FIG. 4 shows a schematic view of a first switching circuit for use in an embodiment.
Figure 5:
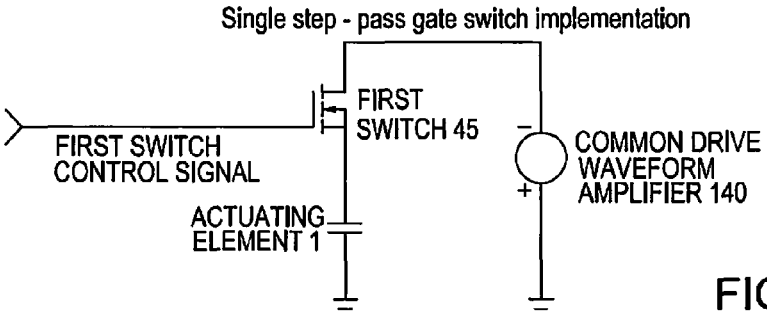
FIG. 5 shows a schematic view of a first switching circuit for use in an embodiment.
Figure 6:
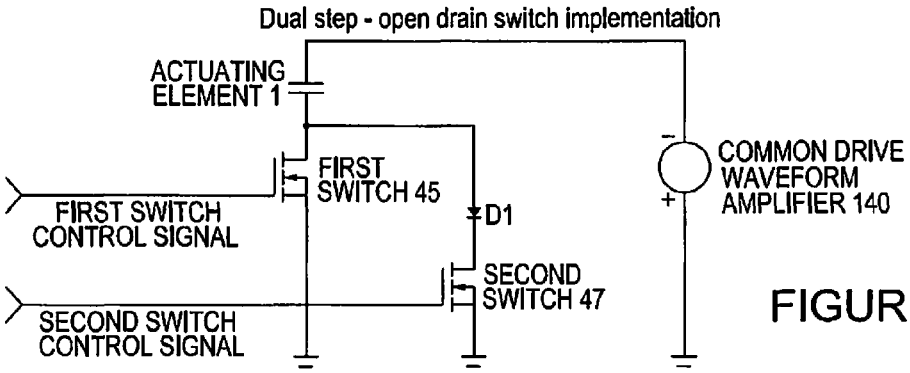
FIG. 6 shows a schematic view of a first switching circuit having a parallel diode for use in an embodiment.
Figure 7:
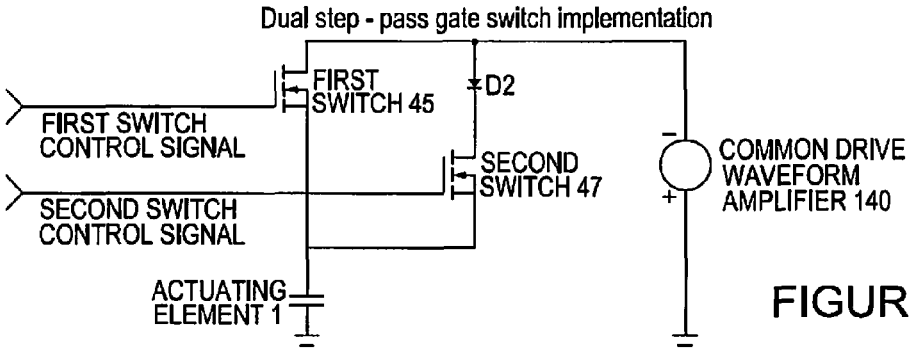
FIG. 7 shows a schematic view of a first switching circuit having a parallel diode for use in an embodiment.

FIGS. 4 to 7 show some examples of the practical implementations of the switching circuit and its connections for such capacitive pre-charge trimming. There are two types of switch shown, called open drain and pass gate, and each type can be used in a single-switch arrangement (FIGS. 4 and 5) or a two-switch arrangement with a parallel diode (FIGS. 6 and 7). For both open drain and pass gate, the switches perform the same task, allowing the description of each method to be switching topology independent. The switches can consist of one or more n and/or p channel MOSFET devices. A notable example uses n-channel LDMOS devices, as such devices can have particularly low thermal dissipation, and sufficiently low parasitic capacitances. FIG. 4 shows a first switch 45 coupled in an open drain configuration to one electrode of the actuating element 1, and a common drive waveform amplifier 140 coupled to the other electrode. Thus the switching circuit is implemented as a single switch. FIG. 5 shows the first switch 45 coupled in a pass gate configuration between the common drive waveform amplifier 140 and one electrode of the actuating element 1. The other electrode of the actuating element is coupled to a return path such as ground. In FIG. 6 the arrangement differs from FIG. 4 in that there is an additional path in parallel with the first switch, and the additional path has a diode D1 and a second switch 47. In FIG. 7 the arrangement differs from FIG. 5 in that there is an additional path in parallel with the first switch, and the additional path has a diode D2 and a second switch 47. The arrangements of FIGS. 4 and 5 can be used with the single step common drive waveform of FIG. 2 or the dual step common drive waveform of FIG. 3. The arrangements of FIGS. 6 and 7 have a particular benefit when used with the dual step common drive waveform of FIG. 3. That will now be explained with reference to FIG. 8.

FIG. 8, Waveforms for Dual Step Example Using Parallel Diode

FIG. 8 shows a time chart similar to that of FIG. 3, and shows the dual step common drive waveform having a return portion. In contrast to FIG. 3, in this case, a switching circuit having two switches is employed; a bi directional switch (first switch 45) and a unidirectional switch and diode combination, (a parallel diode D1, D2, and the second switch 47) as shown in FIGS. 6 and 7. The direction of the diode is dependent on the polarity of the common drive waveform. The significance of the diode is that the start of conduction at the desired time 34 is caused by the presence of the diode without the need for a switch to be opened at a precise time, as will be explained. FIG. 8 shows voltage over time for a single pixel cycle for the operation of the embodiment of FIG. 1 or other embodiments in which the switching circuit has a parallel diode. As in FIG. 3 a solid line shows an example of a common drive waveform, and a dotted line shows a resulting actuation pulse trimmed by adjusting the starting voltage. Below these waveforms is a dot-dash line showing a switching state, open or closed, of the first switch 45 shown along the same time axis at the same scale. Below this is a double-dot-dash line showing a switching state, open or closed, of the second switch 47 shown along the same time axis at the same scale. Below this is a long-dash line showing a conduction state, yes or no, of the diode, shown along the same time axis at the same scale.

The common drive waveform has a pre-charge ramp which has a dual step shape (the same as FIG. 3 described above). As in FIG. 3, at the outset of the cycle the switching circuit closes while the common drive waveform is near zero, a common drive waveform amplifier circuit being in the resting state; allowing the voltage across the actuating element to start to track the common drive waveform. The actuating element firing cycle differs from that described for FIG. 3 as follows. The switching circuit is in a closed state before the waveform cycle begins, which means that either the first switch or the second switch is closed. Since the second switch is closed, the diode is conducting. The slow rise of the pre-charge ramp part of the waveform charges up the capacitance of the actuating element. At a point in time 33, where the voltage on the actuating element is at the correct level to achieve the desired level of droplet velocity/volume trimming, as indicated by the trim signal, the second switch is opened so that the diode does not conduct. The first switch is already open. The electrode of the actuating element coupled by the switching circuit becomes floating. Thus the capacitance of the actuating element causes that electrode to follow the electrode coupled to the common drive waveform. Thus the voltage across the actuating element is held at a constant voltage while the waveform rises to its maximum pre-charge ramp level.

At time point 35, soon after the end of the pre-charge ramp, and after the common drive voltage has dropped below the desired start voltage, the second switch is closed. This enables the diode to conduct as soon as the common drive voltage rises above the start voltage. Hence time point 35 should be anytime during the part of the return portion where the common drive voltage is below the start voltage, for example during the short period where the waveform is at the steady state level. The diode is now reverse biased and no current flows and therefore the actuating element remains at the pre-charged voltage and no heat is generated. At time point 34, the common drive voltage rises above the start voltage by a threshold which causes the diode to conduct, as indicated by a dotted line arrow in FIG. 8. No switch is opened or closed at this point, so there is no need for precise trigger circuitry. The electrode of the actuating element coupled to the diode retains its voltage until the waveform is a diode forward voltage drop higher than this voltage, at which point the voltage across the actuating element tracks the common drive voltage up to its high level. The diode will prevent the discharge of the actuating element, so at the maximum level, at any time before the trailing edge, the first switch should be closed to allow the actuating element to track the waveform back to the resting level. If the first switch is closed during the steeper slope, immediately after the diode starts conducting, there may be some benefit in terms of reduced thermal dissipation, as the conduction path through the first switch may be made to have lower resistance. As in FIGS. 2 and 3, the amount of the rise in voltage along the steeper slope, the ΔV, is the difference between the start voltage, and the maximum voltage level of the pulse.

Figure 9:
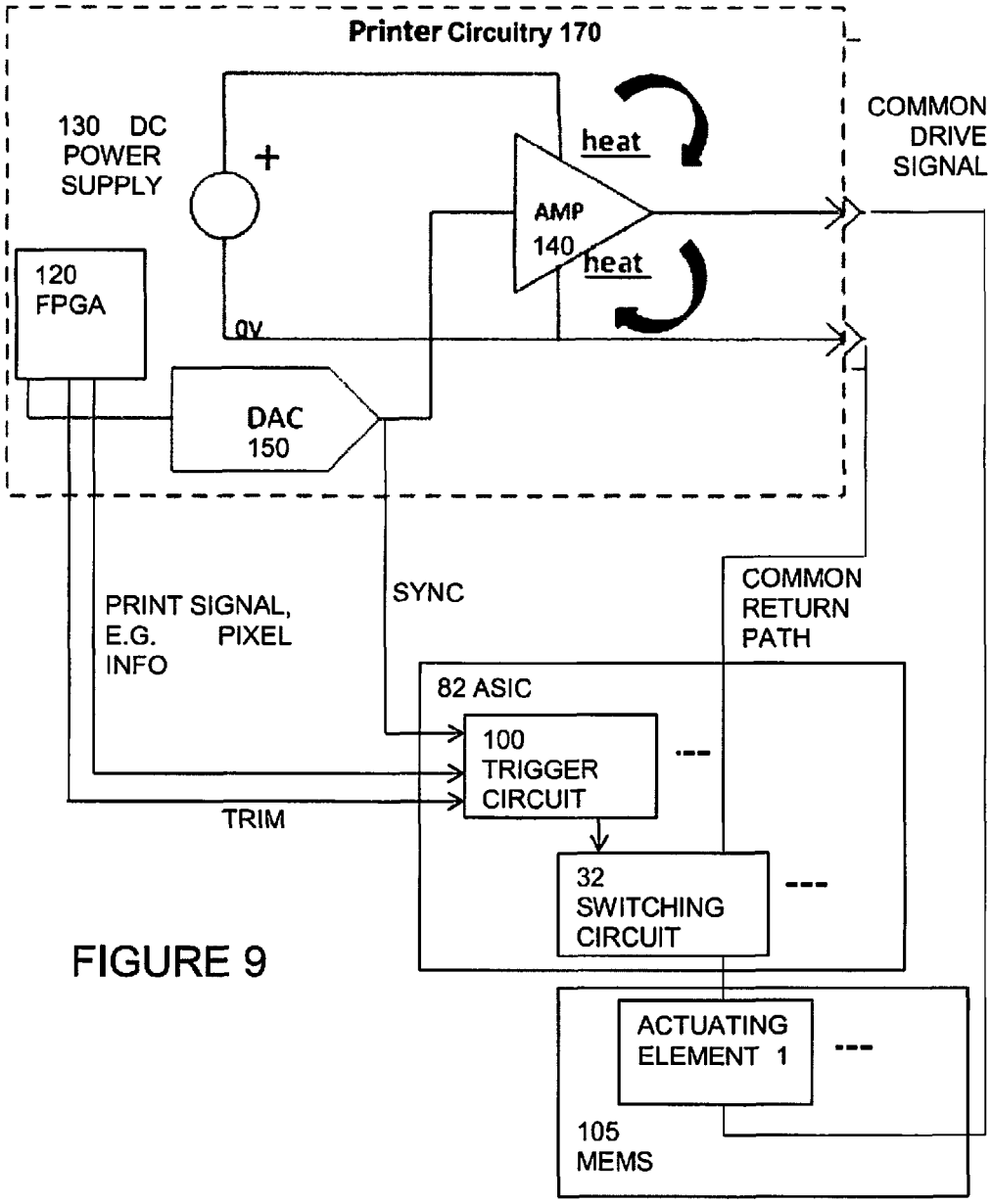
FIG. 9 shows a schematic view of a printhead according to an embodiment.

FIG. 9, Printer Circuitry and Printhead

FIG. 9 shows how the printhead described above can be incorporated with other parts. It shows a schematic view of an example of parts of a printer including the ASIC 82 of a printhead and other parts of the printhead, for generating the common drive signal and the print signal. In some embodiments these can be integrated onto the printhead, but a benefit of having them external to the printhead is that power dissipation on the printhead can be reduced. This is known as a cold switch arrangement.

This "Cold Switch" technique reduces the amount of thermal dissipation on the printhead, moving much of the thermal dissipation onto a higher level circuit board for providing signals common to many printheads, such as the printer circuitry 170. This is a standard piezo printhead technique, used in many industrial piezo printhead systems today, as well as other devices. This thermal dissipation shift is achieved by generating a common power drive waveform on the printer circuitry, and switching it to individual actuating elements on the printhead only during times at which the waveform is not transitioning, and hence not causing current flow in or out of the capacitive load of the actuating elements during switch opening or closing. FIG. 9 illustrates the concept of cold switch drive, with arrows illustrating the location of substantial thermal dissipation.

In practice, the switching circuit 32 in the printhead ASIC has thermal dissipation, from the finite resistance of the switch used in it and for the dissipation in the level shifter used to control the switch. Typically, there is a trade-off between reducing the switch resistance for improved thermals and silicon area cost. The industrial print industry uses this technique due to the high cost of removing heat from the printhead. In FIG. 9, the printer circuitry is provided external to the printhead, having a circuit such as an FPGA 120 for generating print signals for each actuating element at appropriate timings. These print signals can be logic level signals representing pixel information in any way, coded or otherwise, and in black/white, or grey scale or colour and so on. These logic signals can be generated by the FPGA based on a file of digital information such as character codes and character positions for the page to be printed for example. The page could be fed to the printer from a PC, network, or any external source for example.

The same FPGA can also have an output to generate the common drive signal. This logic output is fed to a DAC 150, which produces an analog output which is fed to an amplifier 140 for generating sufficient power at high voltage (e.g. 40 v) to drive the actuating elements. A DC power supply 130 is also shown. The common return path is coupled to the amplifier and to the DC power supply. The printhead is shown implemented as an ASIC 82 and a MEMS 105. The ASIC 82 incorporates a trigger circuit 100 and switching circuit 32 for each actuating element. The MEMS incorporates the actuating element 1, or array of such actuating elements. The common drive signal is fed to the actuating elements from the printer circuitry 170, and the return path is fed from the actuating elements to the printer circuitry 170 via the switching circuit 32 on the ASIC 82. There may be other parts incorporated on the ASIC. A trim signal is fed from the FPGA to the trigger circuit 100.

Switch Operation According to an Embodiment

The common drive waveform is supplied by the printer circuitry 170, as a cold switch system would provide. This drive waveform is driven onto the common first electrode of the actuating element. When the actuating elements are switched on, the individual second electrodes remain near ground potential, with only a small <1V potential determined by the current and switch resistance in the ASIC. When it is desired to not fire an actuating element (it is off), the second electrode will float and then no current will flow in or out of it, except for parasitic capacitance of the (for example n-LDMOS transistor) switch in the ASIC. The drain voltage of that switching transistor will then closely follow the swing of the cold switch common drive waveform, which is driven onto the common first electrode. In this off state, very little current will flow through the electrode, except that provided by the parasitic capacitance of the n-LDMOS in the ASIC. There are limits on actuating element polarity, and some crosstalk to unfired actuating elements can be caused by parasitic capacitances in leads, flex connectors & ASIC paths for example.

The ASIC pad generally only sees positive voltages. Suitable care in design and layout of the ASIC can ensure no latch up results from current flow in the body diode in the switching device in the event of large negative voltages.

Keeper and Idle Bias

Deselected actuating elements can have their charge maintained using some type of keeper interval or a keeper circuit. When an actuating element is not being fired, its bias voltage is required to stay at a certain level. The piezo devices can be actuated by reducing a field during a pulse. So when idle, the actuating elements have an electrical bias voltage and have the largest voltage (and field) that they will experience. Leakage in the actuating element and through the ASIC devices will alter the idle bias on an actuating element if it is not kept or refreshed in some manner. Some designs have used a keeper transistor that switches any idle actuating elements to a bias net provided on the ASIC. But while this is feasible for the pass gate cold switch solutions, an open drain solution does not have the topology that allows this, due to the requirement to float deselected actuating elements. For open drain, a digital function to turn the actuating element ON during some idle period once per pixel cycle should be sufficient to maintain the proper bias on a completely idle actuating element, the "keeper interval."

Figure 10:
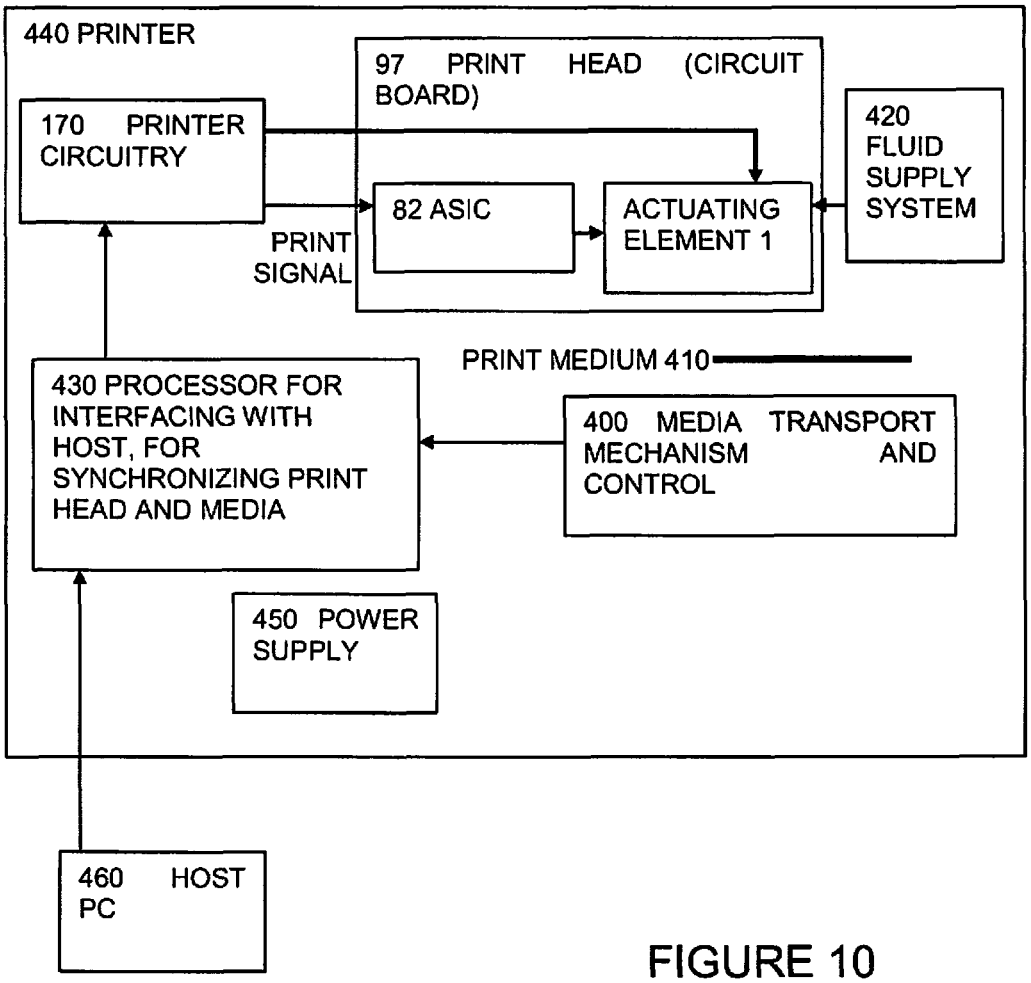
FIG. 10 shows a schematic view of a printer having a printhead according to an embodiment.

FIG. 10, Embodiment Showing Printer Features

The printhead embodiments described above can be used in various types of printer. Two notable types of printer are:

a) a page-wide printer (where printheads in a single pass cover the entire width of the print medium, with the print medium (tiles, paper, fabric, or other example, in one piece or multiple pieces for example) passing in the direction of printing underneath the printheads), and b) a scanning printer (where one or more printheads pass back and forth on a printbar (or more than one printbar, for example arranged one behind the other in the direction of motion of the print medium), perpendicular to the direction of movement of the print medium, whilst the print medium advances in increments under the printheads, and being stationary whilst the printheads scans across).

There can be large numbers of printheads moving back and forth in this type of arrangement, for example 16 or 32, or other numbers.

In both scenarios, the printheads may be mounted on printbar(s) to print several different fluids, such as but not limited to different colours, primers, fixatives, functional fluids or other special fluids or materials. Different fluids may be ejected from the same printheads, or separate printbars may be provided for each fluid or each colour for example.

Other types of printer can include 3D printers for printing fluids comprising polymer, metal, ceramic particles or other materials in successive layers to create solid objects, or to build up layers of an ink that has special properties, for example to build up conducting layers on a substrate for printing electronic circuits and the like. Post-processing operations can be provided to cause conductive particles to adhere to the pattern to form such circuits.

FIG. 10 shows a schematic view of a printer 440 coupled to a source of data for printing, such as a host PC 460 (which can be external or internal to the printer). There is a printhead in the form of a printhead (circuit board) 97 having one or more actuating elements 1 and an ASIC 82. Printer circuitry 170 is coupled to the printhead circuit board, and coupled to a processor 430 for interfacing with the host, and for synchronizing drive of actuating elements on the printhead, and location of the print media. This processor is coupled to receive data from the host, and is coupled to the printhead circuit board to provide synchronizing signals at least. The printer also has a fluid supply system 420 coupled to the printhead, and a media transport mechanism and control part 400, for locating the print medium 410 relative to the printhead. This can include any mechanism for moving the printhead, such as a movable printbar. Again this part can be coupled to the processor to pass synchronizing signals and for example position sensing information. A power supply 450 is also shown, for supplying power to the various parts of the printer (supply connections are omitted from the figure for the sake of clarity).

The printer can have a number (for example 16 or 32 or other numbers) of inkjet printheads attached to a rigid frame, commonly known as a print bar. The media transport mechanism can move the print medium beneath or adjacent the print bar. A variety of print media may be suitable for use with the apparatus, such as paper sheets, boxes and other packaging, or ceramic tiles. Further, the print media need not be provided as discrete articles, but may be provided as a continuous web that may be divided into separate articles following the printing process.

The printheads may each provide an array of actuating chambers having respective actuating elements for ink droplet ejection. The actuating elements may be spaced evenly in a linear array. The printheads can be positioned such that the actuating element arrays extend perpendicular to the motion and also such that the actuating element arrays overlap in the direction perpendicular to the direction of motion. Further, the actuating element arrays may overlap such that the printheads together provide an array of actuating elements that are evenly spaced in the direction perpendicular to the motion (though groups within this array, corresponding to the individual printheads, can be offset in the direction of motion). This may allow the entire width of the substrate to be addressed by the printheads in a single printing pass.

The printer can have circuitry for processing and supplying image data to the printheads. The input from a host PC for example may be a complete image made up of an array of pixels, with each pixel having a tone value selected from a number of tone levels, for example from 0 to 255. In the case of a colour image there may be a number of tone values associated with each pixel: one for each colour. For example, in the case of CMYK printing there will therefore be four values associated with each pixel, with tone levels 0 to 255 being available for each of the colours.

Typically, the printheads will not be able to reproduce the same number of tone values for each printed pixel as for the image data pixels. For example, even fairly advanced greyscale printers (which term refers to printers able to print dots of variable size, rather than implying an inability to print colour images) will only be capable of producing 8 tone levels per printed pixel. The printer may therefore convert the image data for the original image to a format suitable for printing, for example using a half-toning or screening algorithm. As part of the same or a separate process, it may also divide the image data into individual portions corresponding to the portions to be printed by the respective printheads. These packets of print data may then be sent to the printheads.

The fluid supply system can provide ink to each of the printheads, for example by means of conduits attached to the rear of each printhead. In some cases, two conduits may be attached to each printhead so that in use a flow of ink through the printhead may be set up, with one conduit supplying ink to the printhead and the other conduit drawing ink away from the printhead.

In addition to being operable to advance the print articles beneath the print bar, the media transport mechanism may include a product detection sensor (not shown), which ascertains whether the medium is present and, if so, may determine its location. The sensor may utilise any suitable detection technology, such as magnetic, infra-red, or optical detection in order to ascertain the presence and location of the substrate.

The media transport mechanism may further include an encoder (also not shown), such as a rotary or shaft encoder, which senses the movement of the media transport mechanism, and thus the substrate itself. The encoder may operate by producing a pulse signal indicating the movement of the substrate by each millimetre. The Product Detect and Encoder signals generated by these sensors may therefore indicate to the printhead the start of the substrate and the relative motion between the printhead and the substrate.

The processor can be used for overall control of the printer system. This may therefore co-ordinate the actions of each subsystem within the printer so as to ensure its proper functioning. It may, for example, signal the ink supply system to enter a start-up mode in order to prepare for the initiation of a printing operation and once it has received a signal from the ink supply system that the start-up process has been completed it may signal the other systems within the printer, such as the data transfer system and the substrate transport system, to carry out tasks so as to begin the printing operation.

Other embodiments and variations can be envisaged within the scope of the claims.

The invention claimed is:

1. A method of operating a printhead to provide actuation pulses for driving actuating elements for ejecting droplets from an actuator and having steps of:

providing a common drive waveform for coupling to the actuating elements via respective switching circuits, the common drive waveform having a pre-charge ramp followed by a steeper slope, setting a start voltage of a leading edge of an actuation pulse according to a trim input by opening a first of the switching circuits to decouple the common drive waveform from a first of the actuating elements at least part way along the pre-charge ramp, in order to maintain the start voltage across the actuating element, and coupling the first of the actuating elements to the common drive waveform after the pre-charge ramp, in order to enable the voltage across the first actuating element to follow the steeper slope of the common drive waveform to form the leading edge.

2. The method of claim 1, the common drive waveform having the steeper slope directly after the pre-charge ramp.

3. The method of claim 1, the first switching circuit comprising a first switch and the step of coupling after the pre-charge ramp comprising closing the first switch.

4. The method of claim 1, in which a slope of the pre-charge ramp has the same or opposite sign as a sign of the steeper slope.

5. The method of claim 4, the common drive waveform having a return portion between the pre-charge ramp and the steeper slope such that a voltage range of the pre-charge ramp overlaps a voltage range of the steeper slope.

6. The method of claim 5, the first switching circuit comprising a first switch, and a diode (D1, D2) coupled in parallel with the first switch, and the step of coupling the respective actuating element after the pre-charge ramp comprising using the diode to conduct when the common drive waveform, during the steeper slope, exceeds the start voltage by a threshold.

7. The method of claim 6, the step of decoupling comprising opening a second switch coupled in series with the diode to isolate the actuating element for the rest of the pre-charge ramp.

8. The method of claim 5 having the step of closing the first switch after the diode has started conducting.

9. The method of claim 1, the first switching circuit comprising a first switch and the step of coupling after the pre-charge ramp comprising closing the first switch, wherein a slope of the pre-charge ramp has the same or opposite sign as a sign of the steeper slope, and wherein the common drive waveform has a return portion between the pre-charge ramp and the steeper slope such that a voltage range of the pre-charge ramp overlaps a voltage range of the steeper slope.

10. Apparatus for providing actuation pulses for driving a plurality of actuating elements of a printhead from a common drive waveform, the common drive waveform having a pre-charge ramp followed by a steeper slope, and the apparatus having:

a first switching circuit for coupling a respective one of the actuating elements to the common drive waveform, and a trigger circuit coupled to receive a trim input and a synchronisation signal for synchronisation with the common drive waveform and coupled to the first switching circuit to control the first switching circuit to set a start voltage of a leading edge of an actuation pulse according to the trim input by opening the first switching circuit to decouple the common drive waveform from the respective actuating element at least part way along the pre-charge ramp, in order to maintain the start voltage across the actuating element, and also configured to control the first switching circuit to couple the actuating element to the common drive waveform after the pre-charge ramp, in order to enable the voltage across the actuating element to follow the steeper slope of the common drive waveform to form the leading edge.

11. The apparatus of claim 10, the first switching circuit comprising a first switch, and the trigger circuit being configured to close the first switch to couple the actuating element to the common drive waveform after the pre-charge ramp, to enable the voltage across the actuating element to follow the steeper slope of the common drive waveform to form the leading edge.

12. The apparatus of claim 11, the trigger circuit being configured to close the first switch when the common drive waveform, during the steeper slope, reaches the start voltage, for the case that the pre-charge ramp has a slope of the same sign as that of the steeper slope, and the common drive waveform has a return portion between the pre-charge ramp and the steeper slope such that a start of the steeper slope is in a voltage range of the pre-charge ramp.

13. The apparatus of claim 10, the first switching circuit comprising a first switch, a diode (D1, D2) coupled in parallel with the first switch, and a second switch coupled in series with the diode, and the trigger circuit being configured to carry out the decoupling by opening the first and second switches, and being configured to carry out the coupling, for the case that the pre-charge ramp has a slope of the same sign as that of the steeper slope, and the common drive waveform has a return portion between the pre-charge ramp and the steeper slope such that a start of the steeper slope is within a voltage range of the pre-charge ramp, by closing the second switch before the start of the steeper slope, in order to enable the diode to conduct when the common drive waveform, during the steeper slope, exceeds the start voltage by a threshold.

14. The apparatus of claim 10, in the form of an integrated circuit (ASIC 82).

15. The apparatus of claim 10 comprising a printhead having a common drive waveform circuit for generating the common drive waveform, and a plurality of the actuating elements coupled to the first switching circuit.

16. The apparatus of claim 15 configured such that the first actuating element is coupled between the first switching circuit and the common drive waveform circuit.

17. The apparatus of claim 15 configured such that the first switching circuit is coupled between the actuating element and the common drive waveform circuit.

* * * * *